US007549302B2

(12) United States Patent
Duckham et al.

(10) Patent No.: US 7,549,302 B2
(45) Date of Patent: Jun. 23, 2009

(54) TUBULAR KNIT BRA

(75) Inventors: Jadideah Duckham, Atlanta, GA (US); Brian S. Adams, High Point, NC (US); Billie J. Willis, Asheboro, NC (US)

(73) Assignee: Spanx, Inc., Atlanta, GA (US)

( * ) Notice: Subject to any disclaimer, the term of this patent is extended or adjusted under 35 U.S.C. 154(b) by 0 days.

(21) Appl. No.: 11/985,450

(22) Filed: Nov. 15, 2007

(65) Prior Publication Data

US 2008/0127683 A1 Jun. 5, 2008

Related U.S. Application Data

(63) Continuation-in-part of application No. 10/936,089, filed on Sep. 8, 2004.

(51) Int. Cl.
*D04B 7/32* (2006.01)

(52) U.S. Cl. ..... 66/176

(58) Field of Classification Search ..... 66/175, 66/176, 196, 197; 450/65, 39, 92, 40
See application file for complete search history.

(56) References Cited

U.S. PATENT DOCUMENTS 1,502,160 A * 7/1924 Sol ..... 2/172
1,984,326 A * 12/1934 Titone ..... 66/176
3,184,758 A * 5/1965 Hirsch ..... 2/209
3,537,279 A * 11/1970 Epley ..... 66/176
3,772,899 A 11/1973 Novi ..... 66/176
4,531,525 A 7/1985 Richards ..... 128/489
5,850,745 A 12/1998 Albright ..... 66/176
5,944,579 A 8/1999 Fleischman ..... 450/69
6,015,331 A * 1/2000 Ioakim ..... 450/37
6,125,664 A * 10/2000 Browder, Jr. ..... 66/176
6,178,784 B1 1/2001 Marley, Jr. ..... 66/173
6,227,011 B1 5/2001 Cortinovis ..... 66/171
6,805,610 B2 * 10/2004 Luk ..... 450/54
6,824,445 B2 * 11/2004 Oneyear et al. ..... 450/70
6,863,589 B2 * 3/2005 Cano ..... 450/65

* cited by examiner

*Primary Examiner*—Danny Worrell
(74) *Attorney, Agent, or Firm*—K & L Gates LLP

(57) ABSTRACT

A bra formed of a length of tubular knit material flattened into a double ply fabric having rounded top and bottom edges with ends secured to breast pockets to form a torso encircling main body portion. A pair of lengths of tubular knit material flattened into double ply fabrics have ends secured to the main body portion to form shoulder straps having rounded side edges.

8 Claims, 7 Drawing Sheets

TUBULAR KNIT BRA

RELATED APPLICATION

The present application is a continuation-in-part of U.S. patent application Ser. No. 10/936,089, filed Sep. 8, 2004, published Mar. 9, 2006 as Pub. No. US2006/0048547 A1.

FIELD OF THE PRESENT INVENTION

The present invention relates to bras made of tubular knit fabric, and more particularly to bras made of tubular knit fabric flattened into a two ply fabric.

BACKGROUND OF THE PRESENT INVENTION

Bras of knitted fabric are known for use particularly as sports bras worn during physical activity because of their inherent stretchability and resulting body conformability. Because of the comfort of such bras, their use is not limited only to wear during physical activities, but are desirable and advantageous for general use as well.

Conventional knitted bras may be formed of tubular knit tubes with the circumference of the tubes extending around the torso of the wearer, in other words, the wearer is inside the tube or the tube is flattened and cut to form integral shoulder straps and folded to form front and rear bra portions that are secured together at side seams. In either case, time consuming and expensive cutting and sewing operations are required, resulting in an expensive waste of cut away material. Also, importantly, shoulder straps are either formed from separate pieces of edging or ribbons of fabric having ends secured to the main body portion, or the tube is knit of sufficient height to provide material for integral strap portions, resulting in an additional waste of material. Further, uncomfortable and conspicuous edge binding material or ribbons are conventionally required to cover the edges of the main body portion and the edges of the shoulder straps.

There are also tubular knit bras which are formed of flattened knit tubes with ends sewn or connected to form a body encircling two ply fabric. An illustration of this type of bra is disclosed in Novi U.S. Pat. No. 3,772,899, which discloses breast pocket portions formed by distending the fabric by forming and stabilizing by heat and pressure. The disclosed bra is strapless or, alternatively, has conventional shoulder straps secured to the main body portion. Another example of a strapless circular knit bra is disclosed in Albright U.S. Pat. No. 5,850,745, which discloses a tubular knit fabric that is slit axially to form two separate single ply bras that extend around the torso of the wearer with breast pocket peripheries formed of elastic fabric. This patent also discloses a single ply tubular knit strapless bra with its axis extending vertically of the wearer and with edges knit with turned welts.

While the prior art discloses tubular knit bras that are flattened to form a two ply fabric that encircles the body of the wearer, such prior art bras either are strapless or utilize conventional narrow, relatively hard, shoulder straps.

SUMMARY OF THE PRESENT INVENTION

Briefly described, the tubular knitted fabric bra of the present invention is formed from a length of circular knit material flattened into a double ply fabric having ends secured to together with integral breast pockets or secured to separate breast pockets to form a body encircling main bra portion with the double ply fabric having rounded top and bottom edges. Shoulder straps are formed of a pair of lengths of circular knit material flattened into double ply fabrics having ends secured to the main bra portion and having rounded side edges. This results in a bra that can be rapidly and inexpensively produced with the resulting garment being free of any uncomfortable and unsightly edging strips either on the main body portion or on the shoulder straps, and the shoulder straps can be sufficiently wide, which in combination with the absence of edging material, provides comfort without digging into the shoulders of the wearer, which is particularly advantageous when the bra is worn during physical activities, and eliminates hooks, slides or other unsightly connector in the back.

Being tubular knit with the axis of the tube encircling the torso of the wearer, a relatively narrow tube can be knit. Therefore, the fabric can be rapidly and inexpensively knit using hosiery knitting machines or other suitable machines that knit seamless fabric. The fabric is made of elastic yarn with the knitting pattern being variable to produce desirable stretchable and relatively non-stretchable sections in the fabric to suit desired characteristics in the finished bra.

In one embodiment, disclosed in detail in U.S. patent application Ser. No. 10/936,089, from which the present application is a continuation-in-part, the main bra portion may be formed with a pair of enlarged, relatively loosely knit, relatively highly resiliently stretchable breast pockets, which may be formed in both plies of the double ply bra fabric. To provide uplifting support without the need for additional material or inserts, relatively tightly knit, relatively non-stretchable sections may be provided along the bra below the breast pockets. Advantageously, the ends of the shoulder straps are flared outwardly to ends secured to the main body portion at the breast pockets to form continuations of the breast pockets. Further, support of the breast pockets can be enhanced by having the lower areas of the breast pockets slightly more tightly knit and less resiliently stretchable than the upper areas of the breast pockets.

To provide form fitting stability with desired stretchability, side sections may be formed in the bra of relatively tightly knit, relatively non-stretchable areas extending from the breast pockets to a moderately loosely knit, moderately resiliently stretchable back section. Preferably, the side sections have relatively tightly knit, relatively non-stretchable, pronounced ribbed fabric areas extending from adjacent the breast pockets and tapering rearwardly and downwardly to form complementary tapered areas of relatively lesser tightly knit fabric. These areas provide desired form fitting support in the bra.

The ends of the tubular knit fabric are secured together between the breast pockets, where the sewn seam will be of little or no discomfort to the wearer.

In the embodiment that is the subject of the present application, the breast pockets are formed of a material different from the material of the body straps so that the breast pockets may be formed of any suitable material, such as foam plastic material to provide any desirable characteristics while carrying forward the shoulder strap subject matter of the aforementioned knit body straps, application from which the present application is a continuation-in-part, as well as the tubular with the exception that the body straps do not include breast pockets.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENT

Figure 1:
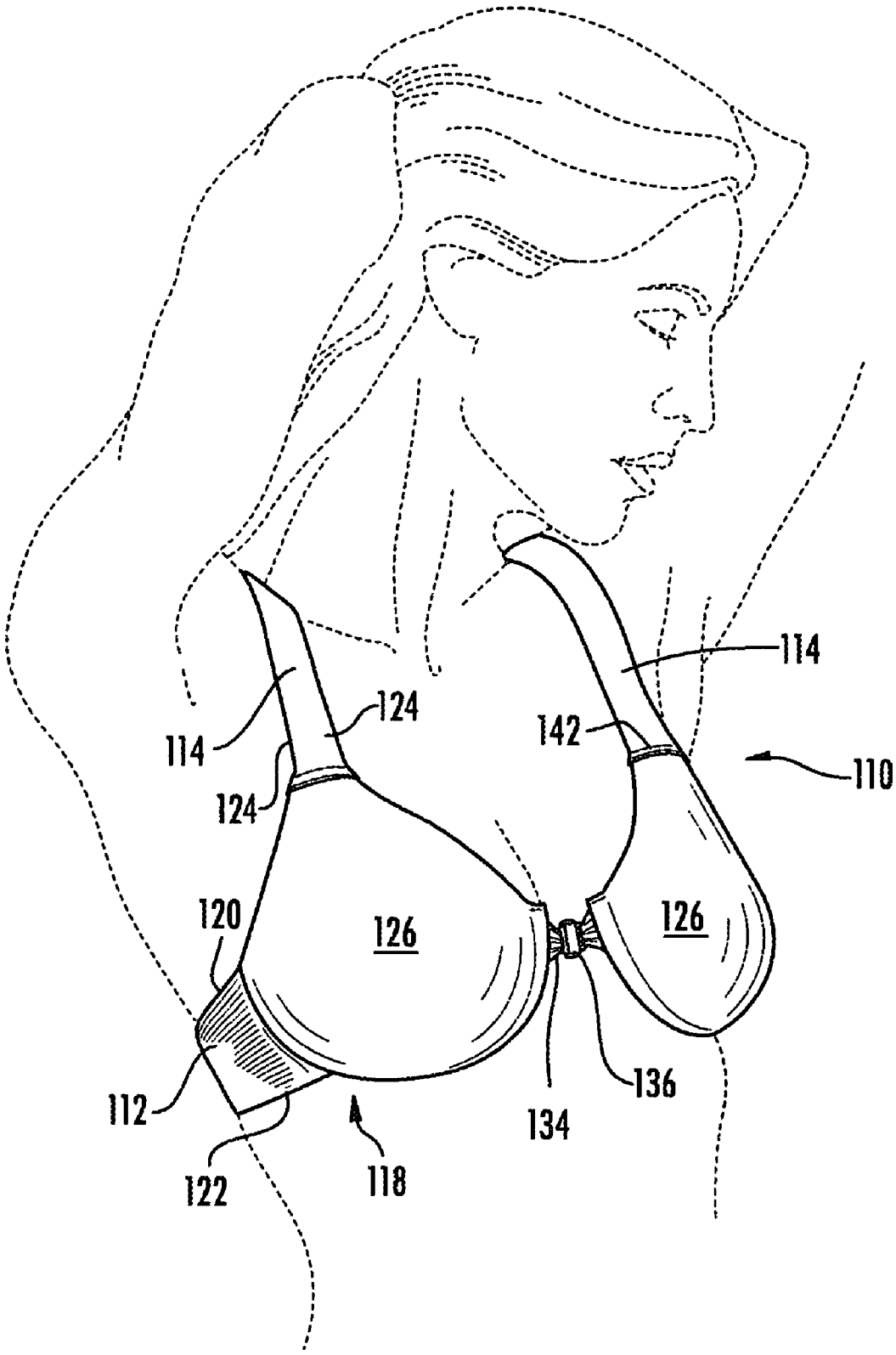
FIG. 1 is a front perspective view of the bra of the preferred embodiment of the present invention illustrated on the body of a wearer.
Figure 2:
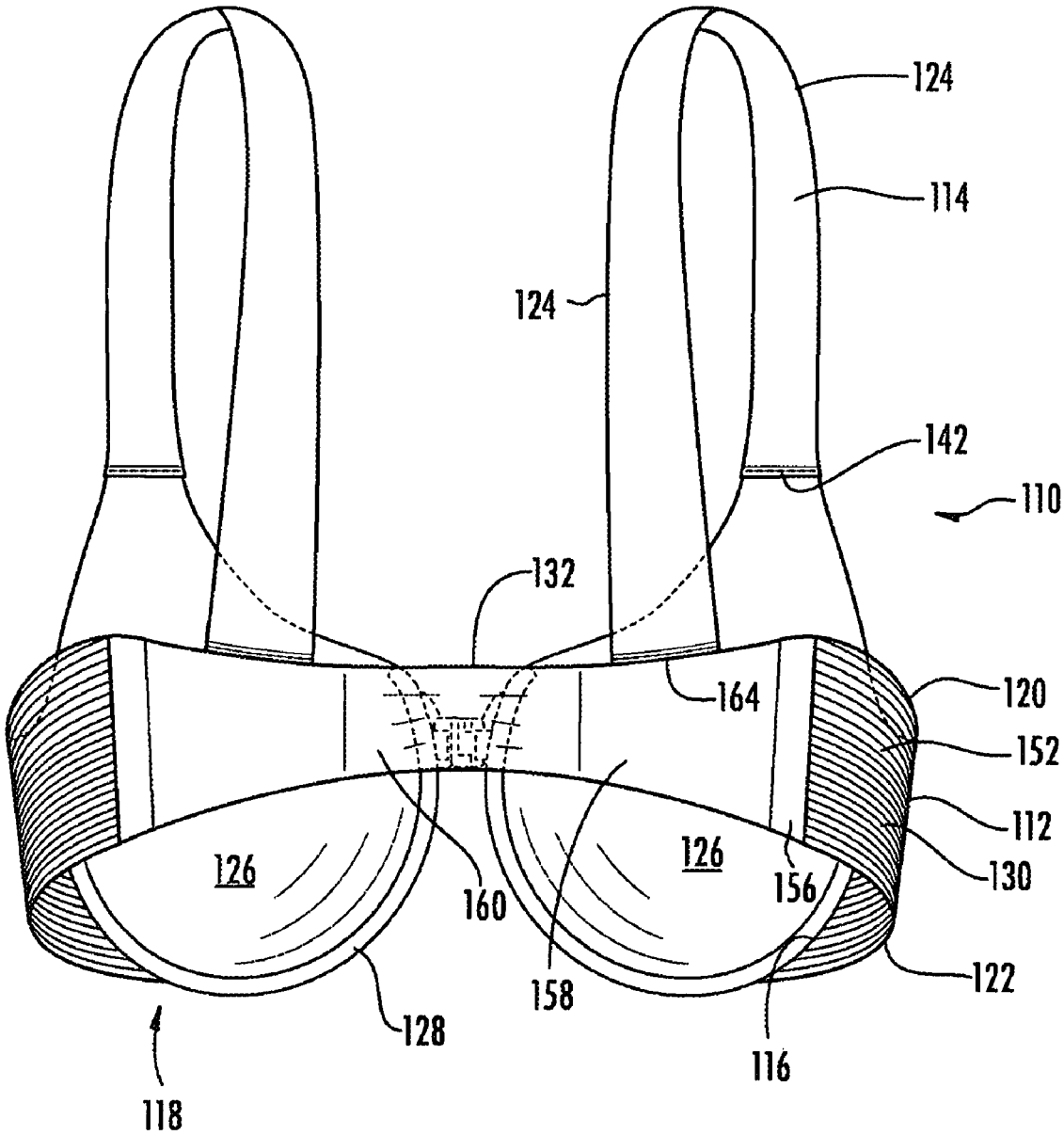
FIG. 2 is a rear perspective view of the bra of FIG. 1 as it appears on a wearer.

As illustrated in the accompanying drawings, the knitted fabric bra 110 of the preferred embodiment of the present invention has a tubular knit body strap 112, a pair of breast pockets 126, and a pair of tubular knit shoulder straps 114. The body straps 112 and shoulder straps 114 are knit of elastic yarn, such as a nylon wrapped spandex core yarn.

The body strap 112 is formed from a length of tubular knit material (FIG. 6), with the strap 112 and attached breast pockets 126 forming a torso encircling main body portion 118. Being tubular knit flattened fabric, the body strap 112 has rounded top and bottom edges 120, 122, respectively, such that no edging or other strips are necessary to cover edges that are formed in prior art bras when cutting material to the shape of the bra from woven material or from single ply tubular knit material or two ply material where the axis of the tube is vertical with respect to the wearer. The resulting smooth edges avoid the uncomfortable, irritating and unsightly edges of bras and that create bulges that are disadvantageous.

The shoulder straps 114 are similarly formed from a pair of lengths of tubular knit material flattened into double ply fabrics that form relatively wide shoulder straps with the vertical axis of the lengths of material extending vertically with respect to the wearer, resulting in side edges 124 formed by the folded edges of the lengths of material, which, like edges 120, 122 of the body strap 112, require no edging or other strip material on the edges, thereby avoiding the discomfort, irritation, unsightliness and bulging of conventional shoulder straps, which advantage is enhanced by the shoulder straps 114 being of sufficient width to avoid digging into the shoulders of the wearer.

As disclosed in the preferred embodiment in the aforesaid application of which this application is a continuation-in-part, the main body portion includes a pair of enlarged, relatively loosely knit, relatively highly resiliently stretchable breast pockets that are resiliently stretchable to comfortably contain and support the breasts of the wearer without requiring stretching of the adjacent sections of the main body portion.

In the modified embodiment disclosed in the present application, the body strap 112 and shoulder straps 114 are generally the same as in the bra of the aforementioned application from which this application is a continuation-in-part, with the modification of the breast pockets 126 being formed of material different from the material of the body straps as in the aforementioned earlier application. Preferably, the breast pockets 126 are formed of foam plastic material and have underwires 128 secured thereto. In the specific embodiment disclosed in the prior application, different shapes and sizes as desired are provided by changes in the knitted fabric, whereas in the present application different shapes and sizes as desired are obtained by changing the shape and material of the breast pockets 126.

To provide form fitting characteristics to the main body portion 112, relatively tightly knit, relatively non-stretchable side sections 130 extend from the breast pockets 126 to a moderately loosely knit, moderately resiliently stretchable back section 132 that extends between and is connected to the two side sections 130 across the back of the wearer.

The side sections 130 are knit ribbed fabric that extends from the breast pockets 126 to provide desired relative form fitting support in the bra 110.

Between the breast pockets 126 there is a relatively short, front section 134, in the center of which there is a hook connector 136 for attaching the bra 110 to a wearer.

The circular knit flattened double ply shoulder straps 114 have front ends 142 that are sewn to the top of the breast pockets 126 and provide upper continuations of the breast pockets 126. The shoulder straps 114 have back ends 164 sewn to the main body portion 112, and extend uniformly between the ends.

Figure 3:
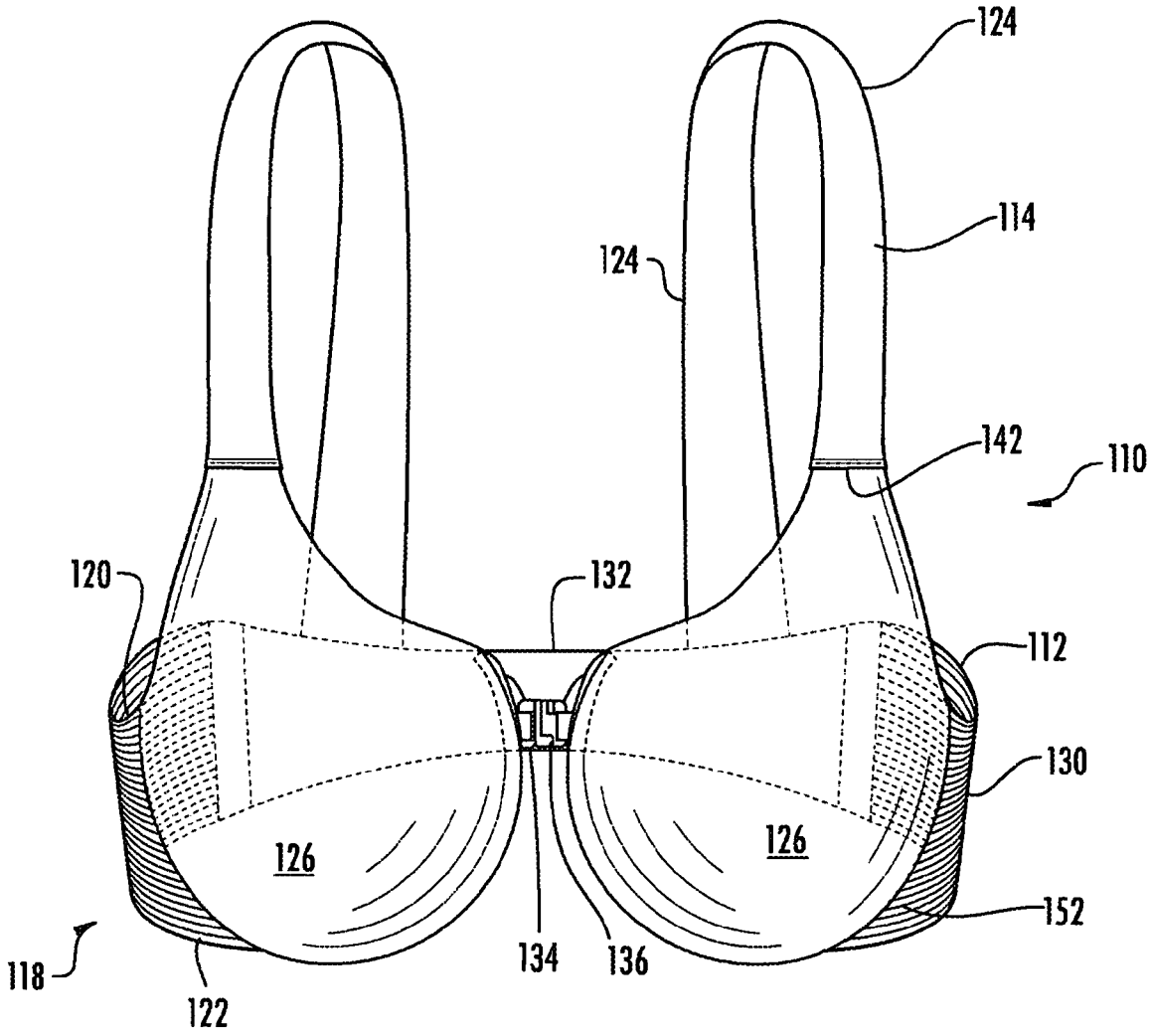
FIG. 3 is a front elevation of the bra of FIG. 1.
Figure 4:
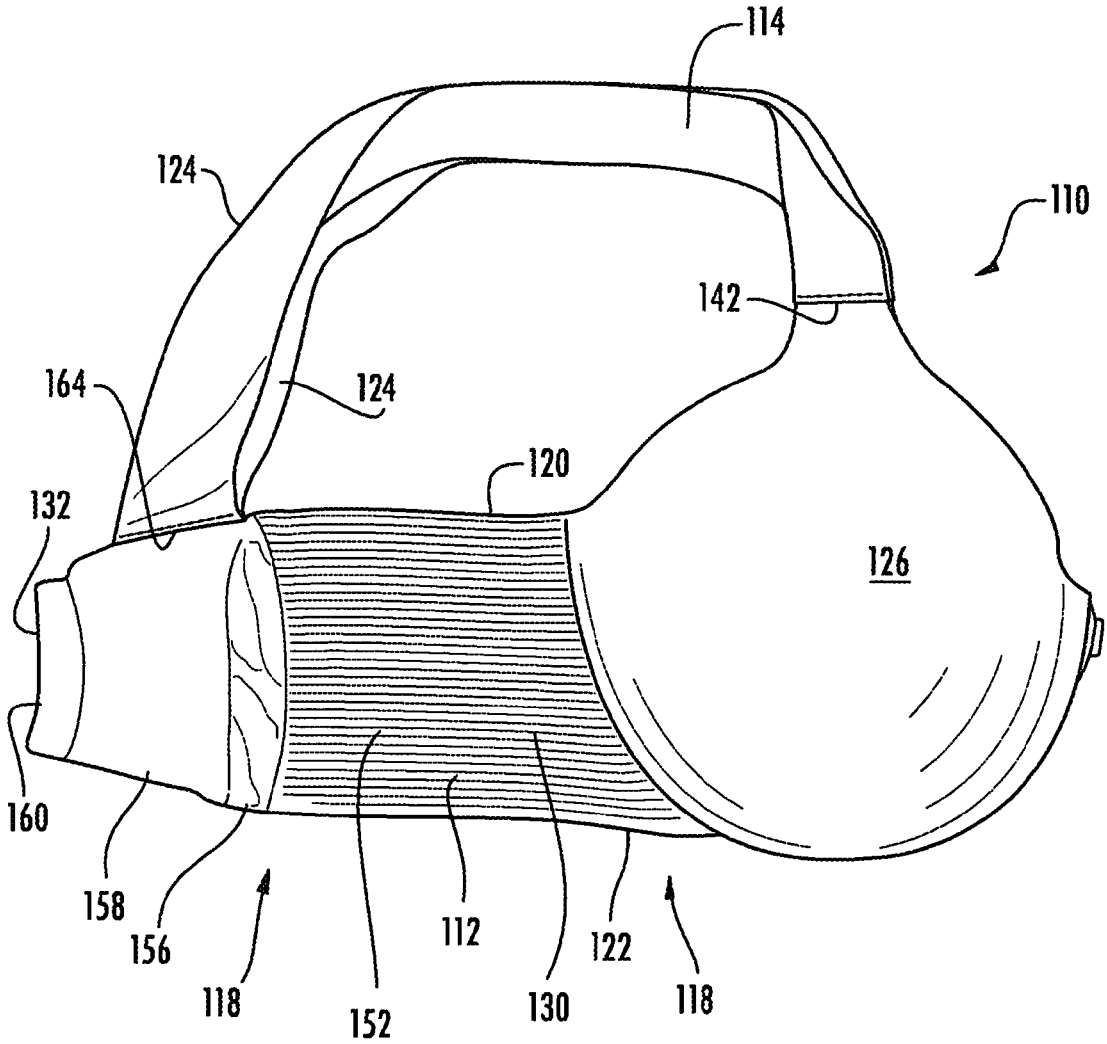
FIG. 4 is a side elevation of the bra of FIG. 3 in relaxed condition.
Figure 5:
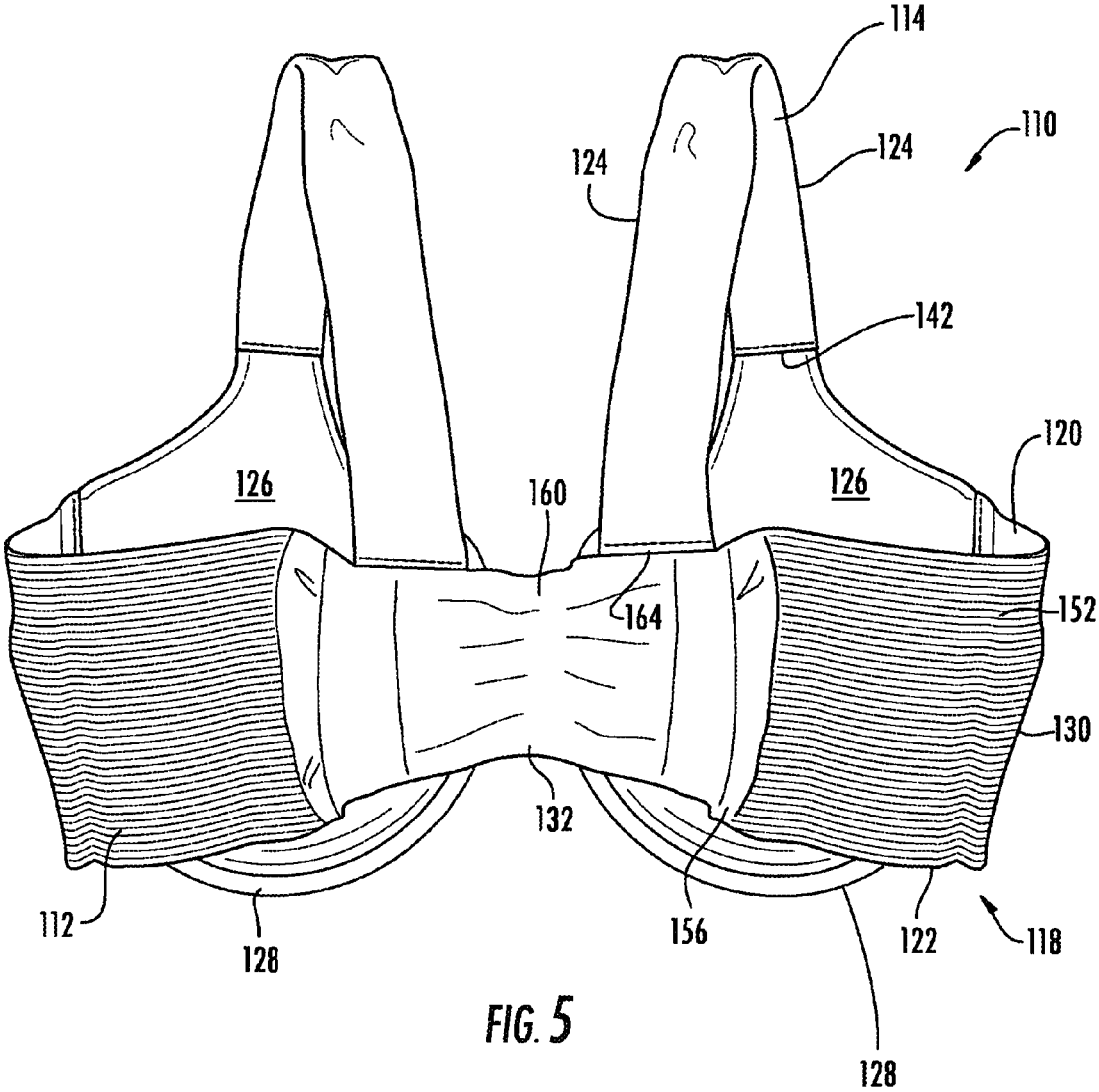
FIG. 5 is a rear elevation of the bra of FIG. 3 in relaxed condition.
Figure 6:
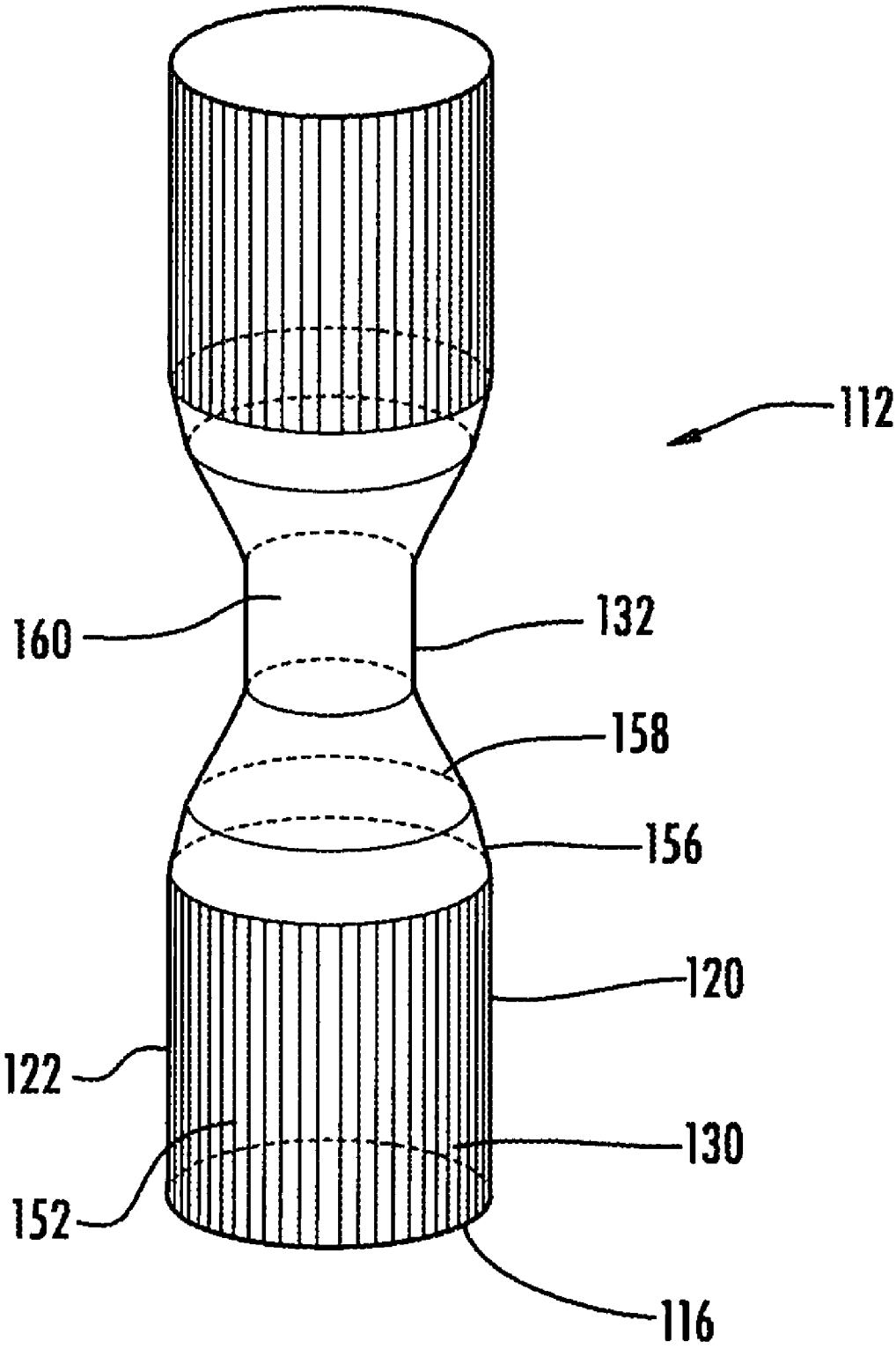
FIG. 6 is an illustration of a length of fabric in tubular form as knit on a circular knitting machine prior to being flattened to form the main body portion of the bra of FIG. 1.

FIGS. 3, 4, and 5 illustrate the bra 110 in its relaxed, unworn condition. The length 118 of circular knit material in the form of a tube in which it is knit prior to being flattened to form the body strap 112 is illustrated in FIG. 6. The end 16 at the bottom of the figure is the first portion to be knit. Knitting then progresses through the side section 130, which is relatively tightly knit and relatively non-stretchable, beginning with a ribbed fabric area 152 to form the complete side section 130.

Following the knitting of the side section 130, knitting continues with the knitting of the back section 132, which begins with a short transition portion 156 that tapers slightly inwardly to an intermediate portion 158 to a slightly narrowed middle portion 160.

Knitting then continues in the reverse order and is completed when the upper end 112 of the length of material 118 is knit and the length of material 118 is removed from the knitting machine. The ends 116 of the length 118 of material are then sewn to the breast pockets 126.

Figure 7:
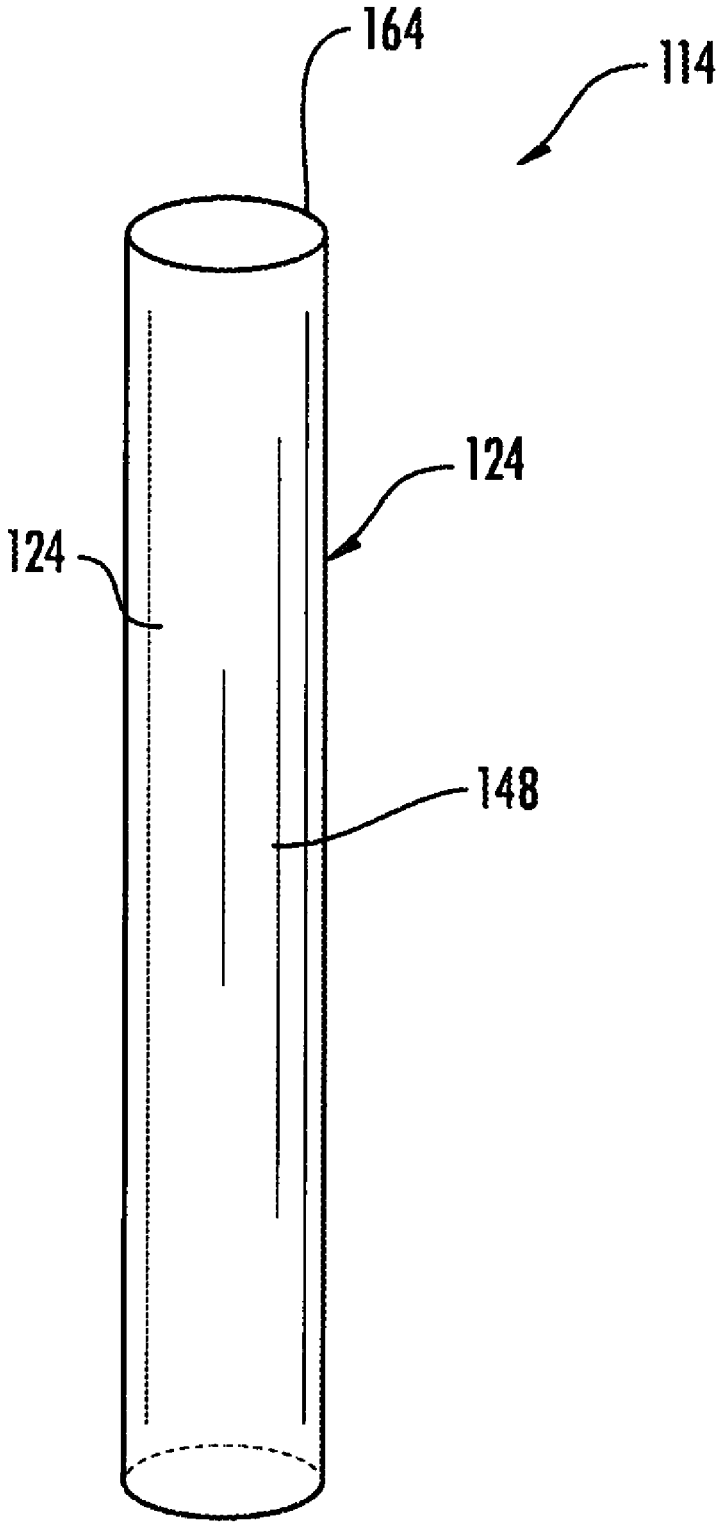
FIG. 7 is an illustration of a length of tubular knit fabric in tubular form as knit on a circular knitting machine prior to being flattened to form the shoulder strap of the bra of FIG. 1.

One length 148 of circular knit material that forms a shoulder strap 114 is illustrated in FIG. 7. The front end 142 of the length 148 is seen at the top of FIG. 7. This is the end that is sewn to a breast pocket 126 of the main body portion 118. The knitting continues to an end 164 that will be connected to the back section 132 of the main body portion 112.

After the tubular length 118 of the main body portion and the tubular lengths 148 of the shoulder straps 114 are knit, they are flattened. The shoulder straps 114 are then sewn to the main body portion 118 and to the breast pockets 126.

The comparative words "relatively" and "moderately" as used herein are to be understood to mean the relation of the characteristics of one section or area of the bra 110 in comparison with other sections and areas.

In a preferred embodiment of the present invention, both the body straps 112 and the shoulder straps 114, are knit on a 400 needle, 4 feed, 4 inch cylinder hosiery knitting machine, such as a Matec HF 4.7 VM (Variable Movement, i.e., the stitch cam is controlled to go in and out and up and down) using a stretch yarn having a spandex core covered by a textured stretch nylon filament yarn wrapped around the core. Other machines that produce tubular knit fabric and other types of yarn may be used as desired.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed:

1. A bra comprising a pair of breast pockets, a body strap connected to said breast pockets, said body strap and breast pockets forming a torso encircling main body portion, and shoulder straps connected to said breast pockets and said body strap, said body strap and said shoulder straps being formed of tubular knit material flattened into double ply fabric having rounded edges, said breast pockets being of a material different from the material of said body straps, said body straps having relatively tightly knit, relatively non-stretchable side sections extending from said breast pockets, and said side sections formed of ribbed fabric.

2. The bra of claim 1 characterized by said ribbed fabric side sections extend to a back section at relatively lesser tightly knit ribbed fabric.

3. The bra of claim 2 characterized by the back section being of moderately loosely knit, moderately resiliently stretchable material.

4. The bra of claim 3 characterized by said back section having short transition portions adjacent said side sections, intermediate portions adjacent said transition portions, and a middle portion between said intermediate portions.

5. A bra comprising a pair of breast pockets, a body strap connected to said breast pockets, said body strap and breast pockets forming a torso encircling main body portion, and shoulder straps connected to said breast pockets and said body strap, said body strap and said shoulder straps being formed of tubular knit material flattened into double ply fabric having rounded edges, said body straps having relatively tightly knit, relatively non-stretchable side sections extending from said breast pockets, and said side sections formed of ribbed fabric.

6. The bra of claim 5 characterized by said ribbed fabric side sections extend to a back section at relatively lesser tightly knit ribbed fabric.

7. The bra of claim 6 characterized by the back section being of moderately loosely knit, moderately resiliently stretchable material.

8. The bra of claim 7 characterized by said back section having short transition portions adjacent said side sections, intermediate portions adjacent said transition portions, and a middle portion between said intermediate portions.

* * * * *